US005591509A

United States Patent [19]

Lorenz et al.

[11] Patent Number: 5,591,509

[45] Date of Patent: Jan. 7, 1997

[54] SKI CONTAINING SHEETLIKE PLATES OR TAPES MADE OF A FIBER REINFORCED MATERIAL

[75] Inventors: Georg M. Lorenz, Königstein/Taunus; Walter Fester, Saal/Donau; Ulrich Schuster, Regensburg; Erhard Leicht, Hofheim am Taunus; Ralph Schäfer, Wiesbaden, all of Germany

[73] Assignee: Hoechst Aktiengesellschaft, Germany

[21] Appl. No.: 811,312

[22] Filed: Dec. 20, 1991

[30] Foreign Application Priority Data

Dec. 24, 1990 [DE] Germany ..... 40 41 740.9

[51] Int. Cl.[6] ..... B32B 5/28; B32B 27/02

[52] U.S. Cl. ..... 428/107; 428/109; 428/111; 428/113; 428/225; 428/228; 428/224; 428/246; 428/288; 428/297; 428/367; 428/400; 428/902; 280/600; 280/601; 280/610

[58] Field of Search ..... 280/610, 601, 280/600; 428/288, 224, 246, 297, 367, 408, 902, 107, 109, 111, 113, 225, 228; 156/307.5, 307.7

[56] References Cited

U.S. PATENT DOCUMENTS

| | | | |
|---|---|---|---|
| 4,518,453 | 5/1985 | Kiisler | 156/307.5 |
| 4,835,046 | 5/1989 | Auduc et al. | 428/408 |
| 5,035,764 | 7/1991 | Blake | 156/327 |
| 5,056,807 | 10/1991 | Comert et al. | 428/349 |

*Primary Examiner*—Patrick Ryan
*Assistant Examiner*—Rich Weisberger
*Attorney, Agent, or Firm*— Connolly & Hutz

[57] ABSTRACT

The ski described is characterized by the use of a selected fiber reinforced material comprising a sheetlike textile material and a thermoset resin, the fiber content being 30–70% by weight and the fiber being not less than 30% by weight synthetic. This material is notable for high flexibility and high restoring forces and confers excellent properties on the ski, for example good vibration damping.

11 Claims, 1 Drawing Sheet

SKI CONTAINING SHEETLIKE PLATES OR TAPES MADE OF A FIBER REINFORCED MATERIAL

Figure 1:
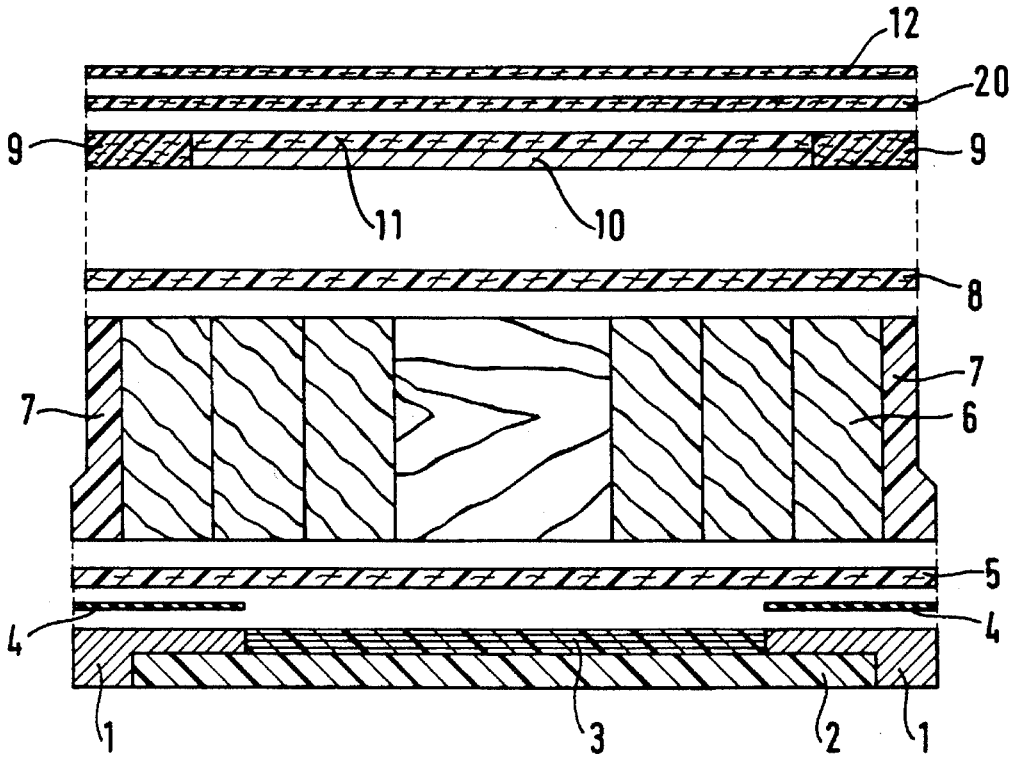

The present invention relates to a ski which contains sheetlike plates or tapes made of a fiber reinforced material comprising a sheetlike textile material and a thermoset resin.

A modern ski, whether alpine or nordic, is customarily made in layer construction. These skis are in general manufactured using a wide range of materials, which are customarily arranged about a so-called core. The core is made for example of wood, a fiber reinforced plastic or a foamed plastic. Situated above and below the core are in general plastic layers or plates or else metal plates, which, when subjected to a shock load, for example when between two bumps the ski bends under the weight of the skier, are either—depending on their position in relation to the core—compressed (compression belts) or tensioned (tension belts). This returns the ski to its original shape. Underneath the tension belts it is customary to position the base with the steel edges. Above the compression belts, which in conventional skis are intended to protect in particular the core, there is in general a top coating, which has in particular decorative purposes.

To assemble the ski from its components, it has been found to be advantageous to use in particular the method of sandwich construction: the load-carrying parts of the ski are placed on top of one another in layers and adhered together by applying a vacuum or pressure. Typically, the plastic layers used above and below the core are glass or carbon fiber reinforced composites based on epoxy resin. It has been found in this context that such plastic layers are not readily coatable with a top coating. Usually, the upper surface must be pretreated with a primer in order that the top coating may be applied. Furthermore, such composite materials are relatively inflexible, since they have high tensile strengths and moduli of elasticity. This has the consequence, inter alia, that the vibration damping offered by the ski structure after a shock stress frequently leaves something to be desired and that individual fiber cracks can result.

Selected fiber reinforced materials have now been found which in the form of sheetlike plates or tapes are highly suitable for manufacturing skis.

The present invention accordingly provides a ski containing sheetlike plates or tapes made of a fiber reinforced material comprising a sheetlike textile material and a thermoset resin, the fiber reinforced material having a fiber content of from 30 to 70% by weight and the fiber material contained therein being at least 30% synthetic fiber.

The ski according to the present invention has a number of surprising advantages over conventional skis as regards fabrication and properties.

For instance, the sheetlike plates or tapes form excellent adhesive bonds with the other materials used. Furthermore, the ski according to the present invention has a high wear resistance, good elasticity and consequently good vibration properties (vibration damping), low weight and as a result thereof a low moment of inertia, and also good temperature properties. Furthermore, the splaying out of fiber ends in the event of mechanical damage to the ski is avoided, much reducing the risk of damage to sportswear.

The fiber reinforced material used for manufacturing the ski according to the present invention consists essentially of a sheetlike textile material and a thermoset resin and has a fiber content of from 30 to 70% by weight, preferably of from 40 to 60% by weight, in particular of from 45 to 55% by weight, the fiber material contained therein being at least 30%, preferably at least 50%, in particular at least 80%, synthetic fiber. As thermoset resin it is in principle possible to use any known crosslinkable, i.e. hardenable, resin system, in particular for example phenolic resins, but also amino resins, epoxy resins, unsaturated polyester resins, polyurethane resins and alkyd resins or combinations thereof.

Particular preference is given to using a fiber reinforced material whose fiber material is 100% synthetic fiber.

As sheetlike textile materials which are contained in the fiber reinforced material used according to the present invention it is possible to use knitted, laid or nonwoven fabrics and in particular woven fabrics. The fiber material of the sheetlike textile materials can be present in smooth or crimped (textured) form and in the form of staple fibers, staple fiber yarns or multifilament yarns. If the sheetlike textile material contained in the material used according to the present invention is a nonwoven material, the fiber material will in general be crimped staple fiber. The staple length of this fiber is in general between 20 and 200 mm. Having regard to special strength requirements, it is particularly advantageous to use staple fibers of about 60–150 mm in length. Of particular advantage for the purposes of the present invention are nonwoven materials formed from staple fibers having an average staple length of from 40 to 120 mm. The nonwovens used in the materials used according to the present invention can advantageously be additionally preconsolidated by a heat treatment, for example by calendering, in particular with embossed calenders, or by means of a binder, for example by means of a thermosetting binder powder or by means of binder filaments having a relatively high melting point, or else by mechanical means, for example by needling.

Woven and knitted fabrics may be made of smooth or preferably textured multifilament yarns or preferably spun (in the sense of secondary spinning) staple fiber yarns. Textured yarn for the purposes of the present invention is any conventionally structured yarn, including in particular effect yarns, for example loop yarns which, owing to fiber ends and loops protruding from the yarn surface or due to the incorporation of thick places, or knobs, are effective in improving the adhesion to the matrix resin. The sheet weights of the sheetlike textile materials contained in the material used according to the present invention are advantageously within the range from 100 to 280, preferably from 120 to 250, in particular from 120 to 150, g/sq.m.

Particular preference is given to those materials whose textile sheet material comprises a staple fiber yarn made of 100% synthetic fiber. The staple fiber yarns can in turn be present as single yarns and as folded yarns, and they may exhibit other known spinning or folding effects.

The textile sheet material used to manufacture the materials used according to the present invention is in particular a plain woven fabric. In a particularly preferred embodiment, this woven fabric comprises staple fiber yarns, in particular staple fiber yarns based on high tenacity polyacrylonitrile fibers.

The fiber material contained in the materials used according to the present invention is at least 30% synthetic. As natural fibers which can be present in the materials used according to the present invention it is possible to use in particular cellulose fibers, such as cotton or jute fibers. As synthetic fibers from which the sheetlike textile materials contained in the materials used according to the present invention are predominantly or preferably exclusively formed it is possible to use in principle any known high tenacity, high modulus, adequately temperature resistant synthetic fiber, for example partly or wholly aromatic polyamide fiber, partly or wholly aromatic polyester fiber, or high tenacity polyacrylonitrile fiber in oxidized or nonoxidized form. Having regard to the cost/benefit ratio and in particular in respect of the adhesion between the fiber material and the thermoset resin and in respect of the adhesion of the sheetlike plates or tapes to the other components of the ski, the use of phenolic resins as thermoset resin and of textile sheet materials of polyacrylonitrile fibers is particularly advantageous. Particular preference is given to the use of high tenacity grades of these synthetic fibers. As mentioned earlier, the synthetic fibers may be present in crimped or uncrimped form and as continuous filament or staple fibers, depending on the nature of the textile sheet material. The linear density of the synthetic fiber is advantageously within the range from 0.7 to 9 dtex, in particular from 1.0 to 6.7 dtex.

Other high temperature resistant fibers should be used in approximately the same linear density ranges, which in any particular case can be determined in appropriate preliminary experiments. The tenacity of the high tenacity fiber grades advantageously used is within the range from 65 to 75 cN/tex in the case of polyethylene terephthalate and above 55 cN/tex in the case of high tenacity polyacrylonitrile grades. The breaking extension of the preferred synthetic fibers is within the range from 14 to 17% in the case of polyethylene terephthalate and within the range from 8 to 17% in the case of the particularly preferred polyacrylonitrile fiber grades.

Particularly preferred materials used according to the present invention contain sheetlike textile materials, in particular woven, laid or nonwoven fabrics, made of highly oriented, nonoxidized polyacrylonitrile fibers, which are commercially available for example under the designation ®Dolanit as type 12 and type 15. These polyacrylonitrile fibers are crimped long fiber grades (staple length about 30–100 mm) which are characterized by good adhesion within the yarn assembly and therefore are readily processible into yarns/fabrics and nonwovens. Such high tenacity fibers, compared with textile polyacrylonitrile fibers, have almost twice as high a fiber tenacity and show good chemical and temperature resistance. A particularly preferred embodiment of the material used according to the present invention contains for example a knitted or in particular a woven fabric formed from a crimped, folded staple fiber yarn made of the high tenacity polyacrylonitrile fiber grade ®Dolanit 15 or alternatively a nonwoven formed from crimped staple fibers composed of the high tenacity polyacrylonitrile fiber grade ®Dolanit 12. As mentioned earlier, the thermoset resins used are preferably phenolic resins.

As phenolic resin the fiber reinforced materials used according to the present invention contain known condensation products of phenol and phenol derivatives with aldehydes, in particular with formaldehyde. Suitable phenolic derivatives are in particular substituted phenols, in particular alkyl-substituted phenols, for example cresols, xylenols and other alkylphenols, e.g. p-tert-butylphenol, octylphenol and nonylphenol, but also arylphenols, for example phenylphenol, naphthols and dihydric phenols, e.g. resorcinol and bisphenol A. Phenolic resins for the purposes of this invention include not only the condensation products of the individual compounds mentioned but also condensation products of mixtures of the abovementioned phenols and phenolic derivatives with aldehydes, in particular with formaldehyde. If individual compounds are to be used for preparing the phenolic resins, care must be taken to ensure that they must be at least trifunctional in relation to the aldehyde. The phenolic resins mentioned may also be modified in a conventional manner for the purposes of optimizing particular properties through additions of unsaturated natural or synthetic compounds such as wood oil, rosin or styrene. Particular preference is given to condensation products of formaldehyde with phenol itself and mixtures of phenol with minor amounts of the phenol derivatives mentioned, in particular of the alkyl-substituted phenols mentioned.

The phenolic resins contained in the materials used according to the present invention customarily have a molar ratio of phenol:formaldehyde of from 1:1 to 1:3, preferably from 1:1.2 to 1:2.2. Suitable phenolic resins are commercially available, for example under the trade name Phenodur VPR 45.

The phenolic resin contained in the fiber reinforced material used according to the present invention preferably additionally contains one or more substances which serve as plasticizing components, i.e. which extend the elasticity range of the resin. Such agents are advantageously contained in the phenolic resin in an amount of from 1 to 25% by weight, preferably from 3 to 10% by weight, in particular from 4 to 7% by weight. Particularly suitable plasticizing components are epoxy resins, alkyd resins and also derivatives of polyvinyl alcohols such as polyvinyl acetals, preferably polyvinyl butyral. Preferred polyvinyl butyral grades are soluble in lower aliphatic alcohols and have a degree of acetalization of from 60 to 75%, preferably from 68 to 72%, and a 6% methanolic solution of the preferred polyvinyl butyral has a viscosity of from 2 to 20, preferably from 4 to 6, mPa.s at 20° C.

The thermoset, especially phenolic, resin contained in the materials used according to the present invention may in addition to the additives mentioned contain further additives which are customary in phenolic resins, for example defoamers, wetting agents, flow control agents, adhesion promoters or else further plasticizing agents and also latent hardeners. These additives, if they are desired, may be present in the thermoset resin in a proportion of up to 2% by weight, preferably within the range from 0.1 to 1% by weight.

Depending on the desired thickness of the sheetlike plates or tapes which are to be produced from the fiber reinforced materials, the material contains an appropriate number of layers of the sheetlike textile material.

The phenolic resin contained in the fiber reinforced materials used according to the present invention is present therein in the virtually fully cured, i.e. crosslinked, state.

Particular preference is given to using those embodiments of the material which comprise a combination of a plurality of the abovementioned preferred features.

The preparation of the sheetlike plates or tapes used according to the present invention is effected in a conventional manner by impregnating a length of the above-described sheetlike textile material in a suitable manner, for example by soaking, padding, brushing or spreading, with a solution of an above-described thermosetting resin which optionally contains one or more of the above-specified additives so that the impregnated material has a fiber content, calculated solid on solid, of from 30 to 70% by weight, preferably of from 40 to 60% by weight. The impregnate thus obtained is subjected to a drying process until nontacky, in the course of which the predominant proportion of the solvent and optionally water is removed and the resin subjected to a further condensation to adjust the flow and hardening characteristics, and then stacked in a plurality of layers and brought into the desired sheetlike form by the application of pressure and heat. To product sheetlike plates or tapes, the dry prepreg is cut into suitable sections, which are stacked on top of one another and subjected to a pressure and heat treatment in the course of which the layers become fused to one another as a result of the flow of the resin.

The sheetlike plates or tapes of fiber reinforced material thus produced can then be used to manufacture the ski according to the present invention using conventional manufacturing techniques.

The fiber reinforced sheetlike plates or tapes used according to the present invention are notable for a particularly high flexibility and high recovery, for a low delamination tendency and for a high resistance to high temperatures and dissolving and/or swelling liquids. Furthermore, these sheetlike plates or tapes possess a very high mechanical strength coupled with very favorable wear characteristics and a high wear resistance and also a low moisture regain.

Also of note is the very good machinability of the plates or tapes used according to the present invention, making it possible to obtain extremely smooth surfaces which are extremely homogeneous and unbroken. Customarily, therefore, the surfaces of these tapes or plates are roughened up by sanding in order to ensure improved adhesion for adjoining layers, such as layers of lacquer.

In general, the ski according to the present invention will be composed of layers of very different materials. However, it is also possible to make a ski exclusively or mainly from the above-characterized sheetlike plates or tapes.

The ski according to the present invention will now be more particularly described by way of example with reference to the cross-sections depicted in FIGS. 1 and FIG. 1 includes a schematic representation of a core (6) which consists of a plurality of units, for example wooden blocks, which have been glued to one another. At the sides of the core there are disposed side walls (7), which are preferably made of a plastic material. The core (6) is adjoined at its upper side by a wide top belt (8) and at its lower side by a wide bottom belt (5). Both the top belt (8) and the bottom belt (5) in this embodiment are made of a glass fiber reinforced plastic. Below the wide bottom belt (5) there are disposed two rubber strips (4). The wide bottom belt (5) is further adjoined on its lower side by a narrow bottom belt (3). In this embodiment the latter comprises sheetlike tapes of a woven fabric of high tenacity polyacrylonitrile fibers which contains a fully cured phenol-formaldehyde resin. The ski is sealed off on its lower side by the base (2), for example in polyethylene, and by the edges (1), for example in steel. The wide top belt (8) is adjoined by a plurality of layers of various materials. In the present case, these layers comprise two prepregs (9), for example a glass fiber reinforced plastic, a top edge (10) made of metal, a narrow top belt (11) in glass fiber reinforced plastic, and further layers (20) and (12) made of prepregs.

Figure 2:
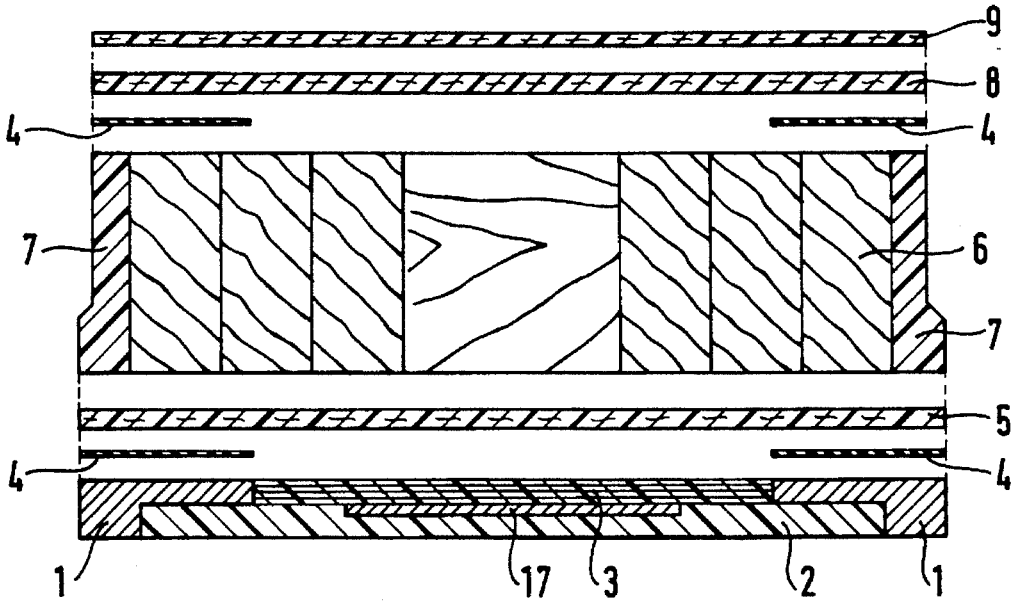

FIG. 2 depicts a further embodiment of the ski according to the present invention. Here the core (6) and the side walls (7) are surrounded by wide top belts (8) and (9) and bottom belt (5) made of glass fiber reinforced plastic. The construction is underlaid with rubber strips (4). Below the wide bottom belt (5) is a narrow bottom belt (3). In this embodiment the latter comprises sheet-like tapes made of a woven fabric or high tenacity polyacrylonitrile fibers which contains a fully cured phenol-formaldehyde resin. The ski is sealed off on the bottom side by the base (2), for example in polyethylene, and by the edges (1), for example in steel. This embodiment additionally contains a metal rail (17), for example in aluminum, between the narrow bottom belt (3) and the base (2).

In a further particularly preferred embodiment, not depicted here, the ski according to the present invention corresponds to the embodiment depicted in FIG. 1 except for the following modifications:

The prepregs (9) are replaced by two metal rails, for example in aluminum; the upper edge of metal (10) and the narrow top belt (11) are replaced by one or two layers of glass fiber reinforced plastic; the further layers (20) and (12) of prepreg are replaced by one or two layers of sheetlike tapes of woven fabric of high tenacity polyacrylonitrile fibers which contains a fully cured phenolformaldehyde resin. In this particularly preferred embodiment, tapes of the highly flexible material of the present invention are used not only above but also below the core (6).

The preparation will now be described by way of example of a prepreg which, after curing, can be used as a sheetlike plate or tape, preferably in a ski according to the present invention.

EXAMPLE

The impregnating trough of an impregnating train is charged with a resin mixture of 100 kg of phenolic resin, 65% in methanol (®Phenodur VPR 45 from Hoechst AG), 26 kg of polyvinyl butyral, 25% in ethanol (®Mowital B 30 T from Hoechst AG), 0.2 kg of a defoamer and 7.9 kg of an organic solvent based on a partially etherified low molecular weight alkanediol.

This resin material was used to impregnate a woven fabric formed from a folded high tenacity polyacrylonitrile staple fiber yarn (®Dolanit 15 from Hoechst AG) and having a basis weight of about 225 g/sq.m on an impregnating train at an impregnating speed of 5 m/min, and the impregnate was then dried at a temperature between 130° and 150° C. The prepreg obtained had the following properties:

resin content: about 46%, resin flow: 14–17%

To determine the resin flow, 4 layers of prepreg measuring 10×10 cm were pressed together at 150° C. under a specific molding pressure of 5–6 bar for 10 minutes. The proportion of resin which was squeezed out was determined quantitatively, and as a percent of the original weight it indicates the so-called resin flow.

What is claimed is:

1. A ski in layer construction wherein at least one of the layers comprises a plate or tape made of a fiber reinforced material construction having enhanced vibration dampening properties compared as to glass fibers comprising a textile material and a thermoset resin, the fiber reinforced material having a fiber content of from 40 to 60% by weight and the fiber material contained therein being at least 50% polyacrylonitrile fiber.

2. The ski of claim 1, wherein the thermoset resin is a phenolic resin.

3. The ski of claim 1, wherein the thermoset resin contains a plasticizing component.

4. The ski of claim 3, wherein the plasticizing component is polyvinyl butyral.

5. The ski of claim 1, wherein the textile material contained in the fiber reinforced material is 100% polyacrylonitrile fiber.

6. The ski of claim 1, wherein the textile material contained in the fiber reinforced material is a knitted, or nonwoven or woven fabric.

7. The ski of claim 1, wherein the resin contained in the fiber reinforced material is a phenol-formaldehyde condensate having a molar ratio of phenol:formaldehyde of from 1:1 to 1:2.

8. The ski of claim 1, wherein the fiber reinforced material comprises a plurality of layers of textile material and thermoset resin.

9. The ski of claim 1, containing a core having upper and lower surfaces each attached to at least one layer of fiber reinforced plastic.

10. The ski of claim 9, wherein the core comprises wood having upper and lower surfaces, a layer of glass-fiber reinforced plastic on the upper surface of the wood, metal rails along each longitudinal side of the reinforced plastic layer, and wherein the plates or tapes are provided on the upper surface of the reinforced plastic layer.

11. The ski of claim 1, wherein the textile material contained in the fiber reinforced material comprises polyacrylonitrile fibers, and wherein the thermoset resin is a phenolic resin.

* * * * *